US009531134B2

(12) United States Patent
Peng

(10) Patent No.: US 9,531,134 B2
(45) Date of Patent: Dec. 27, 2016

(54) ELECTRICAL CONNECTOR

(71) Applicant: LOTES CO., LTD, Keelung (TW)

(72) Inventor: Zhi Guo Peng, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/058,278

(22) Filed: Mar. 2, 2016

(65) Prior Publication Data

US 2016/0285209 A1 Sep. 29, 2016

(30) Foreign Application Priority Data

Mar. 24, 2015 (CN) ..... 2015 2 0165155 U

(51) Int. Cl.
*H01R 13/648* (2006.01)
*H01R 13/6585* (2011.01)
*H01R 13/506* (2006.01)

(52) U.S. Cl.
CPC ..... *H01R 13/6585* (2013.01); *H01R 13/506* (2013.01)

(58) Field of Classification Search
CPC ..... H01R 13/506; H01R 13/6585
USPC ..... 439/607.05, 660
See application file for complete search history.

(56) References Cited

U.S. PATENT DOCUMENTS 9,444,189 B1 * 9/2016 Sattazahn ..... H01R 13/6461
9,461,412 B2 * 10/2016 Yu ..... H01R 13/6585
9,461,425 B2 * 10/2016 Tamaki ..... H01R 13/508
9,466,930 B2 * 10/2016 Little ..... H01R 24/60
9,472,911 B2 * 10/2016 Little ..... H01R 24/60

* cited by examiner

*Primary Examiner* — Khiem Nguyen
(74) *Attorney, Agent, or Firm* — Locke Lord LLP; Tim Tingkang Xia, Esq.

(57) ABSTRACT

An electrical connector includes an insulating body having a base and a tongue, multiple terminals fixed on the insulating body and divided into an upper row and a lower row, upper and a lower grounding sheets abutted on upper and lower surfaces of the tongue, and a middle shielding sheet disposed on the insulating body and located between the upper and lower row of terminals. Each side, close to the base, of the tongue has a retaining slot. Each terminal has a contact portion extending forward and partially exposed from the tongue and a soldering portion extending backward from the base. Each side of the upper and lower grounding sheet has a fixing portion. The fixing portions are fixed in the retaining slots. The middle shielding sheet has reserved portions corresponding to the retaining slots, and the fixing portions are partially located in the reserved portions.

10 Claims, 6 Drawing Sheets

ELECTRICAL CONNECTOR

CROSS-REFERENCE TO RELATED APPLICATION

This non-provisional application claims priority under 35 U.S.C. §119(a) on Patent Application No. 201520165155.0 filed in P.R. China on Mar. 24, 2015, the entire content of which is hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and in particular, to an electrical connector with a good shielding effect.

BACKGROUND OF THE INVENTION

Page 4, paragraphs [0061] to [0063] of the Chinese Patent No. CN 201420404414.6 disclose an electrical connector. The electrical connector includes an insulating body 1. The insulating body 1 includes a bearing base 11 and a tongue 12 that is formed at a front end of the bearing base 11. A reinforcement structure 5 for enhancing the strength of the tongue 12 is mounted at a joint of the tongue 12 and the bearing base 11 (a rear end portion of the tongue). The reinforcement structure 5 includes an upper cover 51 and a bottom cover 52 that are buckled with each other in a fixed manner and cover an outer surface of the rear end portion of the tongue 12. The upper cover 51 includes a first main body plate 511, a first side plate 512 that is bended and formed at each side of the first main body plate 511, and an outward-protruded engagement sheet portion 514 formed on the first side plates 512. The bottom cover 52 includes a second main body plate 521, a second side plate 522 that is bended and formed at each side of the second main body plate 521. A first engagement hole 52 is formed on the second side plates 522, which matches the engagement sheet portion 514 on the first side plate 512.

However, when the foregoing reinforcement structure 5 is assembled, a buckling difficulty is relatively large due to the relatively small sizes of the upper cover 51 and the bottom cover 52. Besides, it is difficult to control the sizes of the engagement sheet portion 514 and the engagement hole 523, because excessively small sizes of the engagement sheet portion 514 and the engagement hole 523 would easily cause unstable buckling of the upper cover 51 and the bottom cover 5 and further cause loosening or even disengagement, and excessively large sizes of the engagement piece portion 514 and the engagement hole 523 would easily result in a gap in a longitudinal direction of the tongue 12 after the upper cover 51 and the bottom cover 52 are buckled, and the gap would cause a mating difficulty when the electrical connector is mated with a mating connector since the mating connector would easily crush into the gap.

Therefore, a heretofore unaddressed need exists in the art to address the aforementioned deficiencies and inadequacies.

SUMMARY OF THE INVENTION

In one aspect, the present invention relates to an electrical connector, of which an upper grounding sheet and a lower grounding sheet are securely abutted on an insulating body by arranging a fixing portion on each of the upper grounding sheet and the lower grounding sheet and enabling the fixing portion to be fixed in a retaining slot of the insulating body.

In one embodiment, an electrical connector includes an insulating body, multiple terminals, an upper grounding sheet and a lower grounding sheet, and a middle shielding sheet. The insulating body has a base and a tongue extending forward from the base. A retaining slot is provided at each side, close to the base, of the tongue. The terminals are divided into an upper row of terminals and a lower row of terminals that are fixedly provided on the insulating body. Each terminal has a contact portion extending forward and partially exposed from the tongue and a soldering portion extending backward from the base. The upper grounding sheet and the lower grounding sheet separately abut on an upper surface and a lower surface, close to the base, of the tongue. Each side of the upper grounding sheet and the lower grounding sheet is provided with a fixing portion, and the fixing portion is fixed in the retaining slot. The middle shielding sheet is disposed on the insulating body and located between the upper row of terminals and the lower row of terminals. The middle shielding sheet is provided with a reserved portion corresponding to the retaining slot, and the fixing portion is partially located in the reserved portion.

In one embodiment, the fixing portion is formed by bending outward from each side of the upper grounding sheet and the lower grounding sheet and is fixed in the retaining slot in an interfering manner.

In one embodiment, the fixing portion is provided with a notch, the retaining slot is provided with a protruding block, and the notch is engaged with the protruding block.

In one embodiment, the middle shielding sheet extends to enable at least a part of the middle shielding sheet to be located in the protruding block.

In one embodiment, in the retaining slot, the fixing portion is fixed with the middle shielding sheet.

In one embodiment, in the retaining slot, the fixing portion is fixed with the middle shielding sheet and the insulating body at the same time.

In one embodiment, a step portion is provided between the tongue and the base. The step portion is provided with an engagement block, the upper grounding sheet or the lower grounding sheet is provided with an engagement hole, and the engagement hole is engaged with the engagement block.

In one embodiment, the upper grounding sheet or the lower grounding sheet is provided with a fastening sheet, the base is correspondingly provided with an engagement slot, and the fastening sheet is inserted in the engagement slot.

In one embodiment, the electrical connector further includes a shielding shell. The shielding shell is provided outside the insulating body, the upper grounding sheet extends backward to form an extending portion, and a top wall of the shielding shell depresses inward to provide protruding points that urge the extending portion.

In one embodiment, the electrical connector further includes multiple terminal slots. The contact portions are correspondingly accommodated in the terminal slots. At least some of the terminal slots are further provided with grooves at regions corresponding to the contact portions. The width of the grooves is less than or equal to the width of the corresponding contact portions.

As compared with the related art, the present invention has the following beneficial advantages: each side of the upper grounding sheet and the lower grounding sheet is bended outward to provide a fixing portion that is correspondingly fixed in the retaining slot at each side, close to the base, of the tongue; the middle shielding sheet is provided with a reserved portion corresponding to the retaining slots; and when the fixing portion is inserted in the retaining slot, the reserved portion provides reserved space, so that the fixing portion is partially located in the reserved portion, thereby enabling the fixing portion to be further fixed in the retaining slot in an interfering manner.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
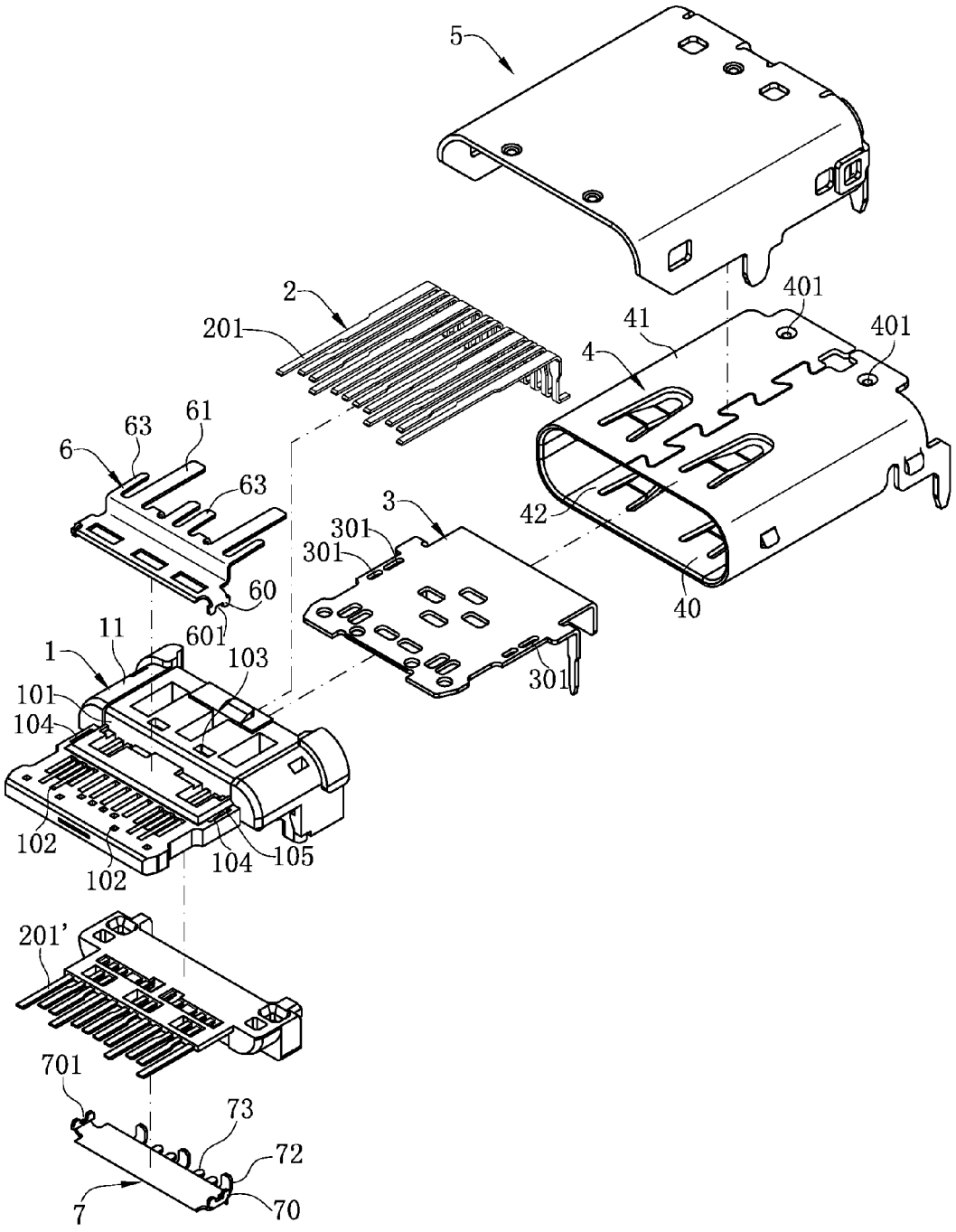
FIG. 1 is a schematic three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-6. In accordance with the purposes of this invention, as embodied and broadly described herein, this invention, in one aspect, relates to an electrical connector.

Figure 2:
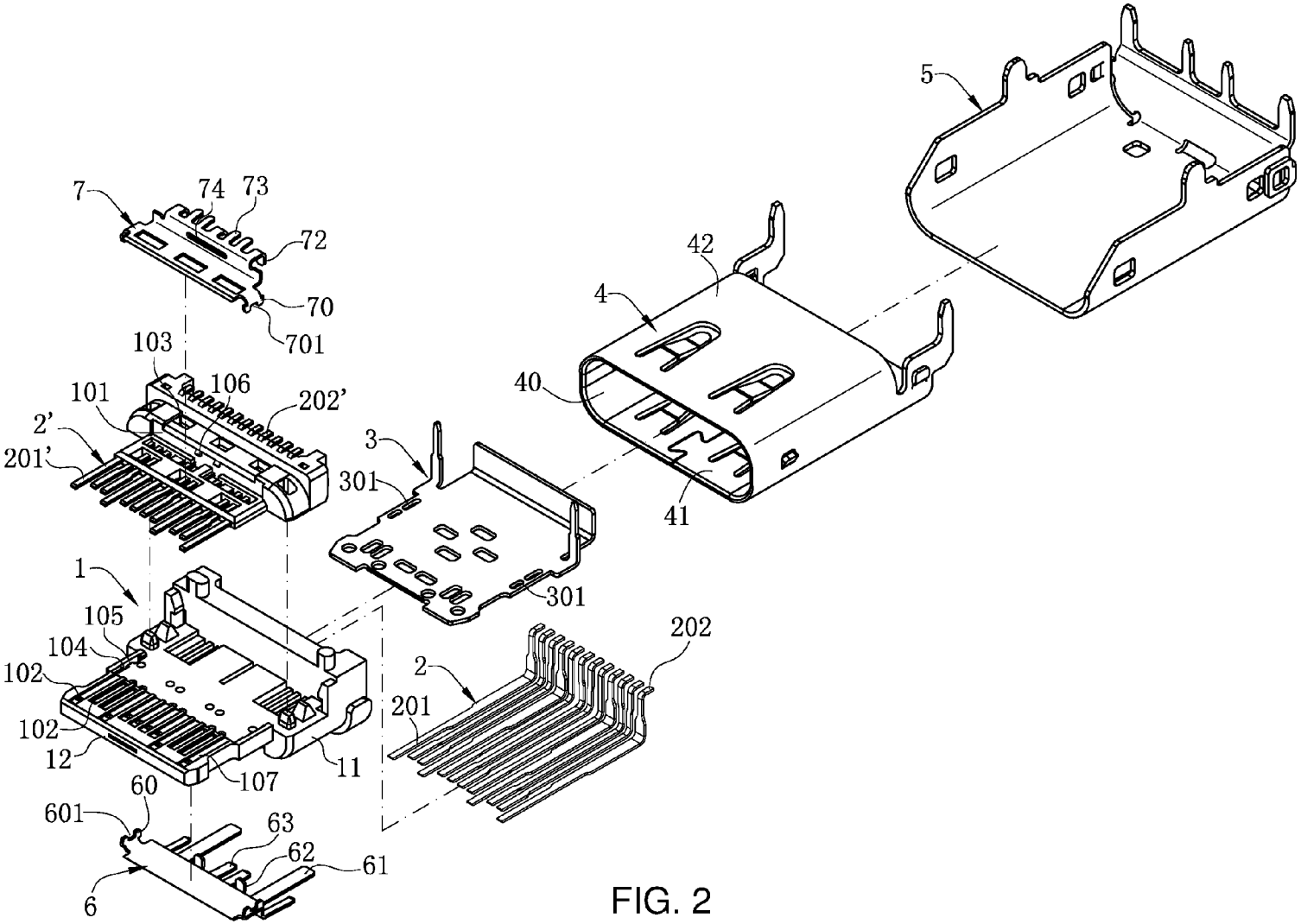
FIG. 2 is a schematic three-dimensional exploded view of an electrical connector from another angle according to one embodiment of the present invention.
Figure 4:
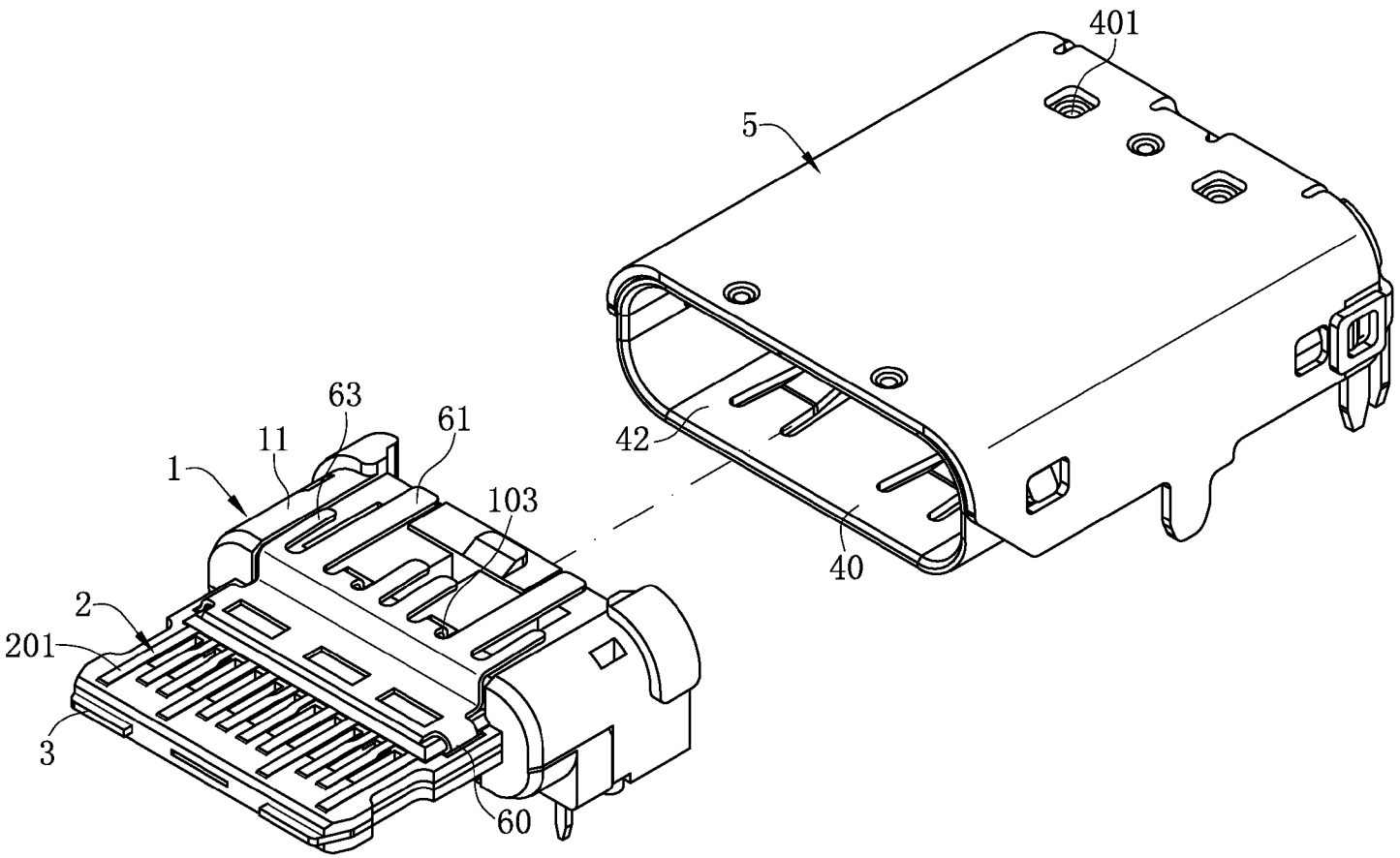
FIG. 4 is a schematic partial three-dimensional assembled view of an electrical connector according to one embodiment of the present invention.

As shown in FIGS. 1, 2, and 4, an electrical connector 100 according to one embodiment of the present invention is configured to be connected to a circuit board (not shown) and includes: an insulating body 1; an upper row of terminals 2 and a lower row of terminals 2', disposed on the insulating body 1; a middle shielding sheet 3, disposed on the insulating body 1 and located between the upper row of terminals 2 and the lower row of terminals 2'; an upper grounding sheet 6 and a lower grounding sheet 7, separately disposed on the insulating body 1; a shielding shell 4, disposed outside the insulating body 1 so as to form insertion space 40; and a metal member 5, disposed above the shielding shell 4.

The insulating body 1 has a base 11 and a tongue 12 extending forward from the base 11. The upper grounding sheet 6 and a lower grounding sheet 7 are respectively abutted on an upper surface and a lower surface, close to the base 11, of the tongue 12, and extend backward to the base 11. Each side of the upper grounding sheet 6 and a lower grounding sheet 7 is bended outward to form a fixing portion 60 or 70. A retaining slot 104 is provided at each side, close to the base 11, of the tongue 12. The fixing portions 60, 70 are correspondingly fixed in the retaining slots 104, so that the upper grounding sheet 6 and the lower grounding sheet 7 are securely abutted on the upper surface and the lower surface, close to the base 11, of the tongue 12. The middle shielding sheet 3 is provided with reserved portions 301 corresponding to the retaining slots 104. When the fixing portions 60, 70 are inserted in the corresponding retaining slots 104, the reserved portions 301 provide reserved spaces, so that the fixing portions 60, 70 are partially located in the corresponding reserved portions 301, thereby enabling the fixing portions 60, 70 to be further fixed in the corresponding retaining slots 104 in an interfering manner. In addition, in the retaining slots 104, the fixing portions 60, 70 may be also fixed with the middle shielding sheet 3, or may be fixed with the middle shielding sheet 3 and the insulating body 1 at the same time, but it is not limited thereto.

Figure 5:
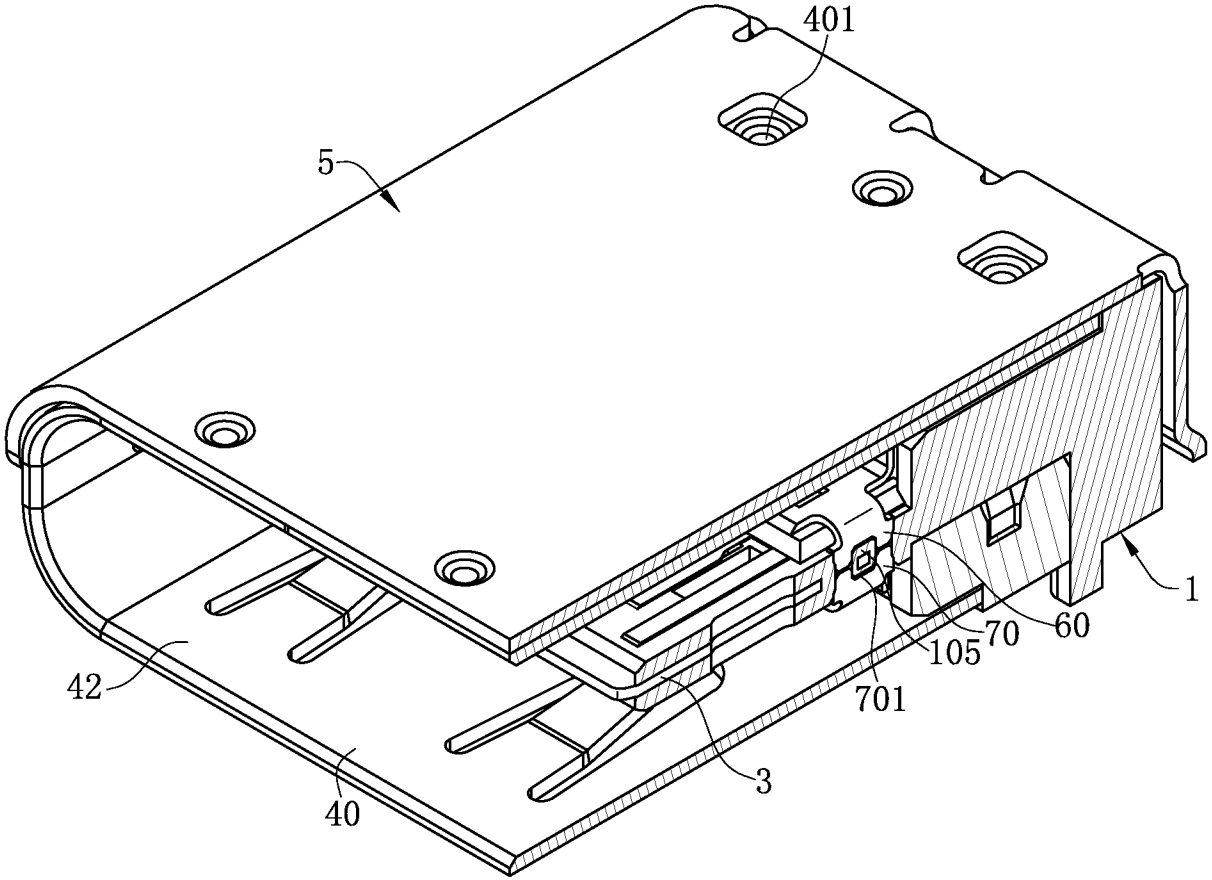
FIG. 5 is a schematic three-dimensional sectional view of an electrical connector according to one embodiment of the present invention.
Figure 6:
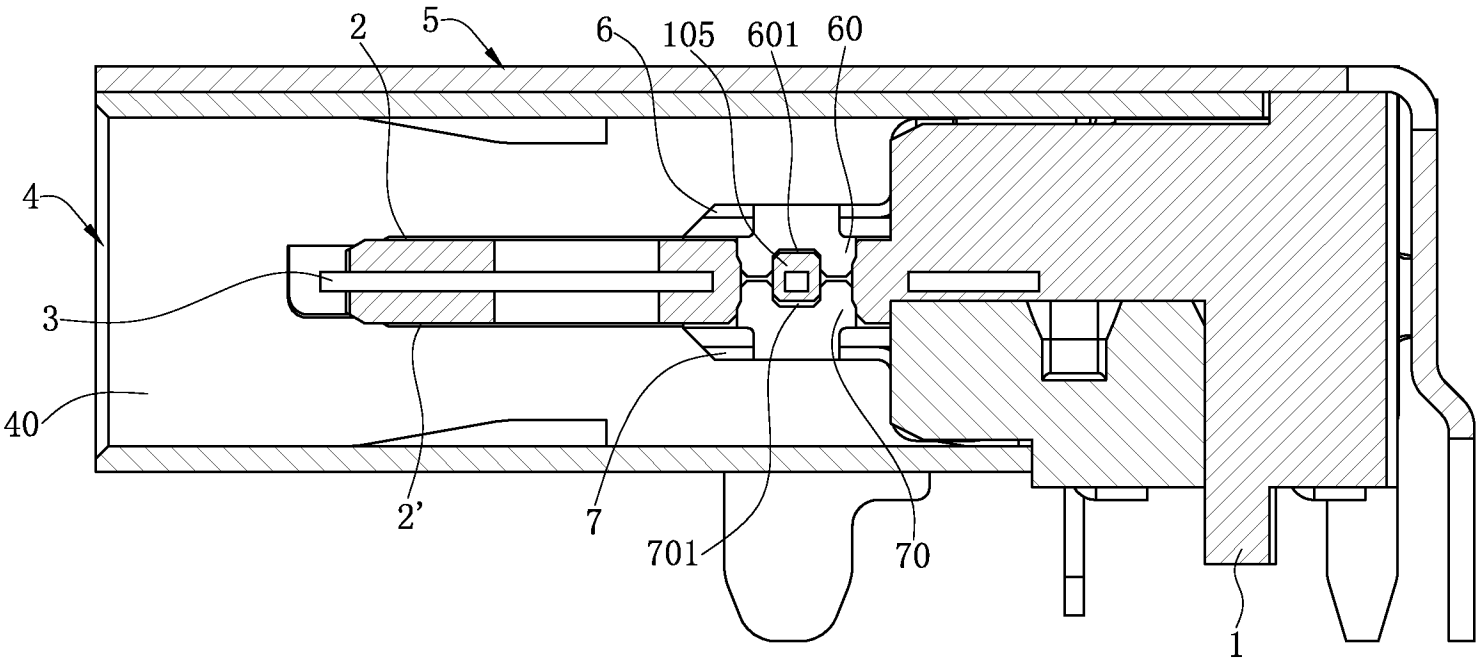
FIG. 6 is a schematic sectional view of an electrical connector according to one embodiment of the present invention.

As shown in FIGS. 2, 5, and 6, a protruding block 105 is further provided in the retaining slot 104. The middle shielding sheet 3 extends to enable at least a part of the middle shielding sheet 3 to be located on the protruding block 105, so as to enhance the strength of the protruding block 105. Each of the fixing portions 60, 70 is provided with a notch 601 or 701. The notches 601 and 701 are correspondingly engaged with the protruding blocks 105, so as to increase interference points of the upper grounding sheet 6 and the lower grounding sheet 7 with the insulating body 1, thereby enabling the upper grounding sheet 6 and the lower grounding sheet 7 to be abutted on an upper surface and a lower surface, close to the base 11, of the tongue 12 in a securer manner. A step portion 101 is provided at a joint of the tongue 12 and the base 11. At least one engagement block 106 is protruded from the step portion 101. The upper grounding sheet 6 or the lower grounding sheet 7 is correspondingly provided with at least one engagement hole 74. The engagement hole 74 is engaged with the engagement block 106, so as to longitudinally fix the upper grounding sheet 6 and the lower grounding sheet 7 on the step portion 101, thereby preventing the upper grounding sheet 6 or the lower grounding sheet 7 from being disengaged. In other embodiments, the upper grounding sheet 6 and the lower grounding sheet 7 are provided with engagement holes 74 at the same time, but it is not limited thereto.

Figure 3:
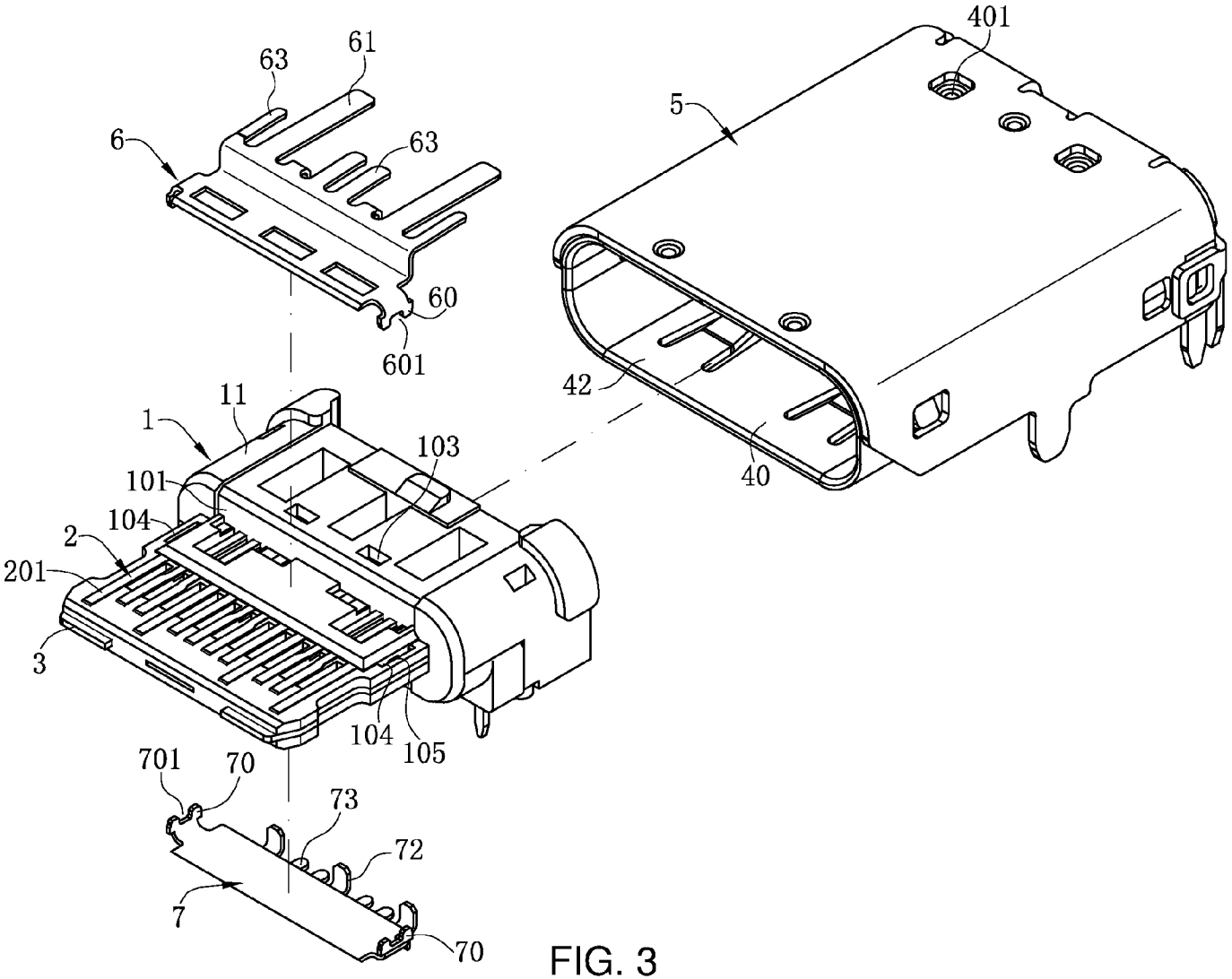
FIG. 3 is a schematic partial three-dimensional exploded view of an electrical connector according to one embodiment of the present invention.

As shown in FIGS. 1-3, portions of the upper grounding sheet 6 and the lower grounding sheet 7 that extend to the base 11 are bended to form fastening sheets 62, 72. The base 11 is correspondingly provided with engagement slots 103. The fastening sheets 62, 72 are inserted in the engagement slots 103, so as to respectively fix the upper grounding sheet 6 and the lower grounding sheet 7 on the base 11. In addition, the upper grounding sheet 6 extends backward to form an extending portion 61 that is adhered to the base 11. Two sides of a rear end of a top wall 41 of the shielding shell 4 depress inward to form two protruding points 401. The protruding points 401 abut the extending portion 61, so as to electrically connect the upper grounding sheet 6 and the shielding shell 4. The upper grounding sheet 6 and the lower grounding sheet 7 are further respectively provided with multiple elastic arms 63, 73 separately abutting the top wall 41 and a bottom wall 42 of the shielding shell 4, so as to enhance the stability of the contact between the upper grounding sheet 6 and the lower grounding sheet 7, and the shielding shell 4, thereby improving an overall shielding effect of the electrical connector 100.

As shown in FIGS. 1 and 2, the upper row of terminals 2 and the lower row of terminals 2' have contact portions 201, 201' extending forward and partially exposed from the upper surface and the lower surface of the tongue 12 and soldering portions 202, 202' extending backward from the base 11. The soldering portions 202, 202' of the upper row of terminals 2 and the lower row of terminals 2' are divided into a front row of soldering portions and a one-to-one corresponding rear row of soldering portions, and are soldered to the circuit board by using a surface-mount technology (SMT). The upper surface and the lower surface of the tongue 12 are respectively provided with multiple terminal slots 107. The contact portions 201, 201' of the upper row of terminals 2 and lower row of terminals 2' are correspondingly provided received in the terminal slots 107. At least some of the terminal slots 107 are further provided with grooves 102 at regions corresponding to the contact portions 201, 201'. The grooves 102 are located between the contact portions 201, 201' of the upper row of terminals 2 and lower row of terminals 2' and penetrate through the tongue 12. The width of the grooves 102 is less than or equal to the width of the corresponding contact portions 201, 201', so as to reduce the impedance between the contact portions 201, 201' of the upper row of terminals 2 and lower row of terminals 2' and improve a transmission rate. In other embodiments, each terminal slot 107 is provide with a groove 102 at a region corresponding to each of the contact portions 201, 201', but it is not limited thereto.

In summary, the electrical connector 100 according to certain embodiments of the present invention has the following beneficial advantages.

(1) Each side of the upper grounding sheet 6 and the lower grounding sheet 7 is bended outward to provide a fixing portion 60, 70 that is correspondingly fixed in the retaining slots 104 at either side, close to the base 11, of the tongue 12. The middle shielding sheet 3 is provided with reserved portions 301 corresponding to the retaining slots 104. When the fixing portions 60, 70 are inserted in the corresponding retaining slots 104, the reserved portions 301 provide reserved spaces, so that the fixing portions 60, 70 are partially located in the corresponding reserved portions 301, thereby enabling the fixing portions 60, 70 to be further fixed in the retaining slots 104 in an interfering manner.

(2) A protruding block 105 is provided in each of the retaining slots 104. The middle shielding sheet 3 extends to enable at least a part of the middle shielding sheet 3 to be located on the protruding blocks 105, so as to enhance the strength of the protruding blocks 105. The fixing portions 60, 70 are provided with notches 601, 701. The notches 601, 701 are correspondingly engaged with the protruding blocks 105, so as to increase interference points of the upper grounding sheet 6 and the lower grounding sheet 7 with the insulating body 1, thereby enabling the upper grounding sheet 6 and the lower grounding sheet 7 to be abutted on the upper surface and the lower surface, close to the base 11, of the tongue 12 in a securer manner.

(3) The upper grounding sheet 6 extends backward to form an extending portion 61 that is adhered to the base 11. Two sides of a rear end of a top wall 41 of the shielding shell 4 depress inward to form two protruding points 401. The protruding points 401 abut the extending portions 61, so as to electrically connect the upper grounding sheet 6 and the shielding shell 4.

(4) At least one engagement block 106 is protruded from the step portion 101. The upper grounding sheet 6 or the lower grounding sheet 7 is correspondingly provided with at least one engagement hole 74. The engagement hole 74 is engaged with the engagement block 106, so as to longitudinally fix the upper grounding sheet 6 and the lower grounding sheet 7 on the step portion 101, thereby preventing the upper grounding sheet 6 or the lower grounding sheet 7 from being disengaged.

(5) At least some of the terminal slots 107 are further provided with grooves 102 at regions corresponding to the contact portions 201, 201'. The grooves 102 are located between the contact portions 201, 201' of the upper row of terminals 2 and lower row of terminals 2' and penetrate through the tongue 12. The width of the grooves 102 is less than or equal to the width of the corresponding contact portions 201, 201', so as to reduce the impedance between the contact portions 201, 201' of the upper row of terminals 2 and lower row of terminals 2' and improve a transmission rate.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, having a base and a tongue extending forward from the base, wherein a retaining slot is provided at each side, close to the base, of the tongue;

a plurality of terminals, received in the insulating body and divided into an upper row of terminals and a lower row of terminals, wherein each terminal has a contact portion extending forward and partially exposed from the tongue and a soldering portion extending backward from the base;

an upper grounding sheet and a lower grounding sheet, respectively abutted on an upper surface and a lower surface, close to the base, of the tongue, wherein each side of the upper grounding sheet and the lower grounding sheet is provided with a fixing portion, and each of the fixing portions is fixed in corresponding one of the retaining slots; and a middle shielding sheet, disposed on the insulating body and located between the upper row of terminals and the lower row of terminals, wherein the middle shielding sheet is provided with reserved portions corresponding to the retaining slots, and each of the fixing portions is partially located in corresponding one of the reserved portions.

2. The electrical connector of claim 1, wherein each of the fixing portions is formed by bending outward from corresponding one of the sides of the upper grounding sheet and the lower grounding sheet and is fixed in corresponding one of the retaining slots in an interfering manner.

3. The electrical connector of claim 1, wherein each of the fixing portions is provided with a notch, each of the retaining slots is provided with a protruding block, and the notches are correspondingly engaged with the protruding blocks.

4. The electrical connector of claim 3, wherein the middle shielding sheet extends to enable at least a part of the middle shielding sheet to be located in the protruding block.

5. The electrical connector of claim 1, wherein in each of the retaining slots, the corresponding fixing portion is fixed with the middle shielding sheet.

6. The electrical connector of claim 1, wherein in each of the retaining slots, the corresponding fixing portion is fixed with the middle shielding sheet and the insulating body at the same time.

7. The electrical connector of claim 1, wherein a step portion is provided between the tongue and the base, the step portion is provided with an engagement block, the upper grounding sheet or the lower grounding sheet is provided with an engagement hole, and the engagement hole is engaged with the engagement block.

8. The electrical connector of claim 1, wherein the upper grounding sheet or the lower grounding sheet is provided with a fastening sheet, the base is correspondingly provided with an engagement slot, and the fastening sheet is inserted in the engagement slot.

9. The electrical connector of claim 1, further comprising a shielding shell disposed outside the insulating body, wherein the upper grounding sheet extends backward to form an extending portion, and a top wall of the shielding shell depresses inward to provide protruding points that urge the extending portion.

10. The electrical connector of claim 1, further comprising a plurality of terminal slots, wherein the contact portions are correspondingly accommodated in the plurality of terminal slots, at least some of the terminal slots are further provided with grooves at regions corresponding to the contact portions, and the width of the grooves is less than or equal to the width of the corresponding contact portions.

* * * * *